United States Patent [19]

Potter

[11] 4,090,525

[45] May 23, 1978

[54] VAPOR RECOVERY SYSTEM

[75] Inventor: Gordon C. Potter, Houston, Tex.

[73] Assignee: Exxon Research & Engineering Co., Linden, N.J.

[21] Appl. No.: 795,057

[22] Filed: May 9, 1977

Related U.S. Application Data

[63] Continuation of Ser. No. 658,941, Feb. 17, 1976, abandoned.

[51] Int. Cl.[2] ..... B67D 5/04

[52] U.S. Cl. ..... 137/171; 141/52; 137/587; 220/85 VR; 220/85 VS; 62/54; 62/55

[58] Field of Search ..... 137/587, 171; 220/85 VR, 85 VS; 141/52; 62/54, 55

[56] References Cited

U.S. PATENT DOCUMENTS

| | | | |
|---|---|---|---|
| 3,672,180 | 6/1972 | Davis | 220/85 VR |
| 3,815,327 | 6/1974 | Viland | 141/52 X |

*Primary Examiner*—Alan Cohan
*Attorney, Agent, or Firm*—John S. Schneider

[57] ABSTRACT

An automatic pump-out for an underground vapor line drop-out tank used at gasoline service stations and related locations. Condensed gasoline vapors and gasoline (liquid) which collect in gasoline service station vapor recovery systems flow by gravity through a vapor line to an underground drop-out tank. An underground storage is located adjacent the drop-out tank. A fill pipe extends from the surface into the storage tank and a discharge pipe connects the storage tank to the surface gasoline pumps. The drop-out tank and storage tank are provided with vent lines. The storage tank contains a vertically positioned pipe, having an open lower end and a closed upper end, extending from the top to adjacent the bottom thereof. A tube connects the bottom of the drop-out tank to the top of the vertically positioned pipe. The tanks are arranged such that when the storage tank is filled the difference in the level of liquid in the vertical pipe and the level of the liquid in the storage tank is equal to the height of the liquid in the drop-out tank. As liquid is withdrawn from the storage tank the dropping liquid column in the vertical pipe lowers the pressure in the vapor space in the vertical pipe thereby drawing liquid up the tube between the drop-out tank and the storage tank. When the level of liquid in the storage tank has dropped sufficiently to create a vacuum higher than the lift required in the tube, flow of liquid will commence from the drop-out tank and continue into the vertical pipe in the storage tank until the drop-out tank is empty without additional lowering of the liquid level in the storage tank.

6 Claims, 5 Drawing Figures

VAPOR RECOVERY SYSTEM

This is a continuation of application Ser. No. 658,941, filed Feb. 17, 1976 now abandoned.

BACKGROUND OF THE INVENTION

The present invention relates to filling and discharging underground storage tanks at gasoline service stations and, particularly, automatically pumping an underground vapor line drop-out tank into the storage tank as the storage tank is discharged.

SUMMARY OF THE INVENTION

Briefly, the preferred form of my invention concerns a vapor recovery system for use at gasoline service stations to permit automatic pump-out of a vapor line drop-out tank and includes an underground gasoline storage tank having a fill pipe and a vent pipe extending to the surface of the ground. An underground gasoline vapor line drop-out tank is located adjacent to the storage tank and is provided with a vapor line extending to the service station pumps and a vent pipe extending to the surface of the earth. A vertical pipe having an open lower end and closed upper end extends through the storage tank from the top to adjacent the bottom thereof. A small tube connects the bottom of the drop-out tank to the top of the vertical pipe. The relative positions of the drop-out tank and underground storage tank causes flow of liquid gasoline to commence from the drop-out tank to the underground storage tank through the tube and to continue flow until the drop-out tank is empty without further lowering of the liquid level in the underground storage tank when the liquid level in the underground storage tank has dropped far enough to create a vacuum higher than the lift in the tube connecting the drop-out tank and the vertical pipe in the storage tank.

DESCRIPTION OF THE PREFERRED EMBODIMENT

Figure 1:
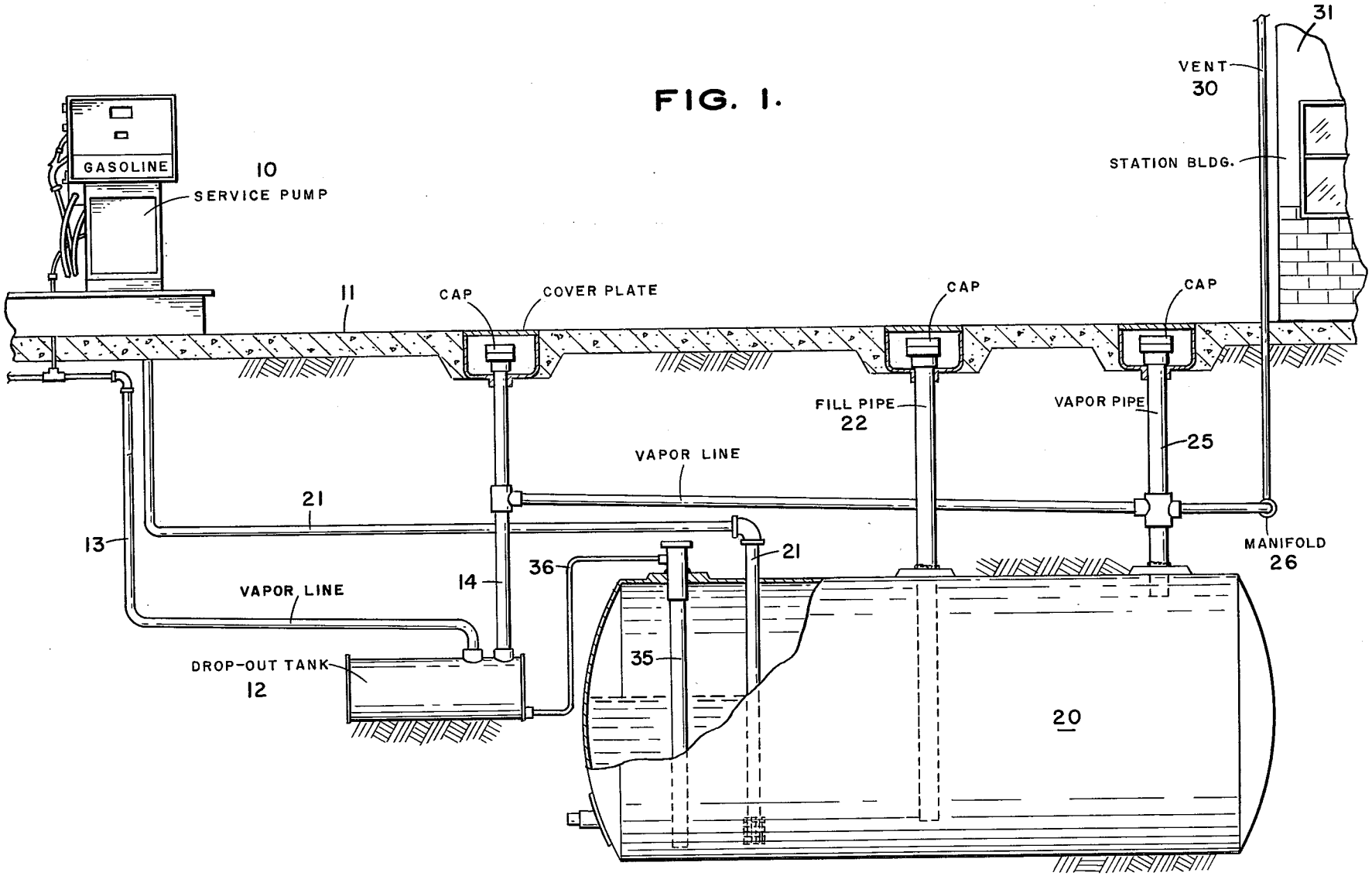
FIG. 1 illustrates the system, in accordance with the invention, of a gasoline service station pump; an underground drop-out tank; an underground storage tank; and various vent, fill and pump lines connected thereto.
Figure 2:
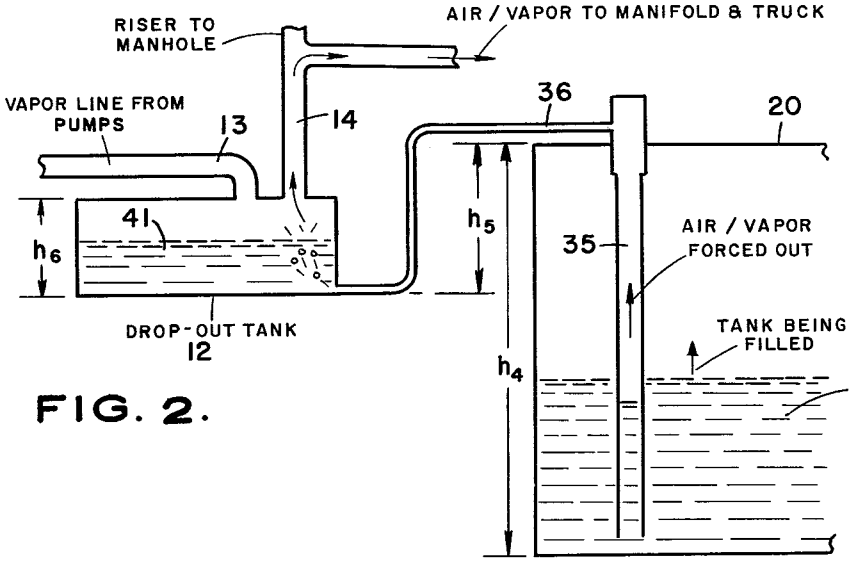
FIGS. 2 to 5 illustrate the operation of the invention as the underground storage tank is filled and emptied.

There is shown in FIG. 1 a surface gasoline service pump 10 installed on surface 11. An underground vapor line drop-out tank 12 is connected to pump 10 through a vapor line 13. An access pipe 14 connects the upper portion of drop-out tank 12 and surface 11. An underground gasoline storage tank 20 is connected to pump 10 by means of the conduit indicated at 21. A storage fill pipe 22 extends into the interior of main storage tank 20 from the surface. Storage tank 20 is also provided with a vapor pipe 25 which is connected to access pipe 14 by a manifold 26 which in turn is connected to a surface vent pipe 30 shown adjacent a service station building 31. A vertical tube or pipe 35 extends from the top to near the bottom of tank 20 (within 2 or 3 inches of the bottom) and a smaller tube 36 connects the bottom of drop-out tank 12 to the upper end of tube 35. Tube 36 may be a ½ inch diameter copper tube and tube 35, which is closed at its upper end and open at its lower end, may be suitably a 3½ inch diameter steel tube.

Figure 3:
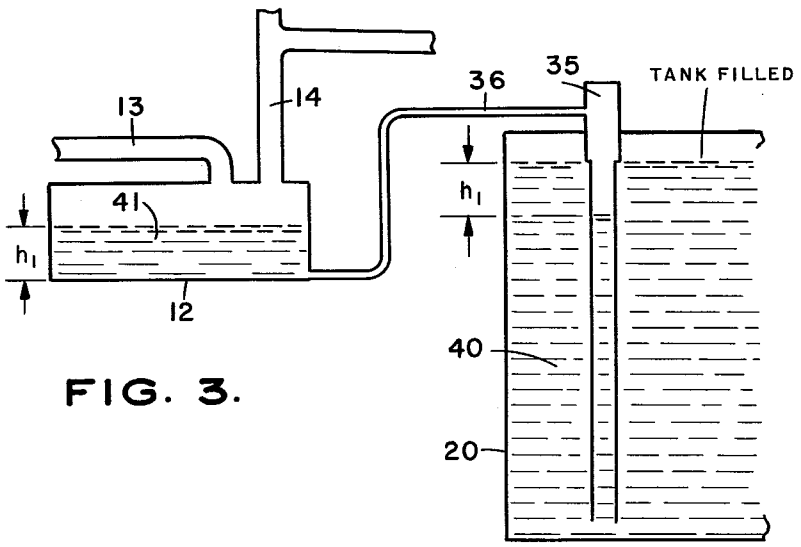

Referring to FIGS. 2 to 5 for a description of the operation of the invention gasoline liquid indicated at 40 rises in storage tank 20 as it is being filled through fill pipe 22 from a truck, not shown. Air and/or vapor in tube 35, as indicated by the arrowed lines, is forced upwardly through tube 35 and through tube 36 into drop-out tank 12 whence it moves upwardly through the liquid 41 in drop-out tank 12, through vent pipe 14 and vent pipe 25 to a truck, not shown. As seen in FIG. 3, at the conclusion of the dump when storage tank 20 has filled there remains a height $h_1$ difference in the level of the liquid 40 in tank 20 and the level of liquid in pipe 35 which is equal to the head $h_1$ of the liquid 41 in drop-out tank 12, as shown.

Figure 4:
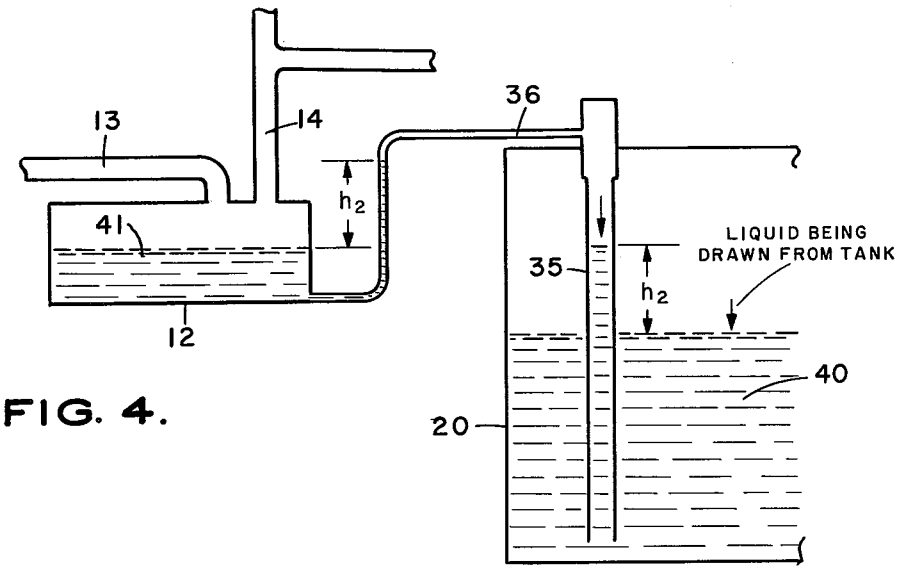

As liquid is withdrawn from storage tank 20, as indicated in FIG. 4, the dropping liquid column in tube 35 lowers the pressure in the vapor space in tube 35 drawing liquid from drop-out tank 12 up tube 36 as shown by the height $h_2$ which is the difference between the liquid level in tube 35 and the level of liquid in tank 20.

Figure 5:
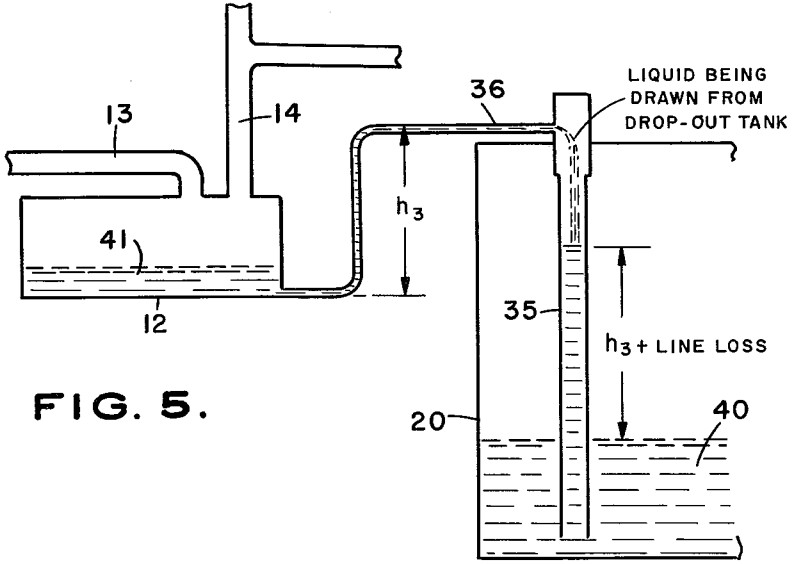

As seen in FIG. 5, when the level of liquid in underground tank 20 has dropped sufficiently to create a vacuum higher than the lift, $h_3$, in tube 36 flow will commence from drop-out tank 12 and continue until drop-out tank empties without further lowering of the liquid level in storage tank 20. The distance between the level of liquid in tube 35 and the liquid level in tank 20 is the height $h_3$ plus line loss. The maximum length, $h_5$, from the top of tank 20 to the bottom of tank 12 is equal to the height (or diameter), $h_4$, of tank 20 divided by two, $h_5 \max = h_4/2$. The height (or diameter) of tank 12, $h_6$, is typically about 12 inches.

Variations may be made in the preferred embodiment described herein without departing from the spirit and scope of the invention as defined in the appended claims.

Having fully described the system, objects, advantages and operation of my invention, I claim:

1. A vapor recovery system for use with a gasoline service station pump comprising:

an underground gasoline storage tank having a fill pipe and a vapor pipe extending to the surface of the ground;

an underground gasoline vapor drop-out tank, smaller than said storage tank, located adjacent said storage tank and having a vapor line extending to said service station pump and a vapor pipe extending to said surface and connected to said storage tank vapor pipe;

a vent means, both of said vapor pipes connecting to said vent means; a vertically positioned pipe having an open lower end and a closed upper end extending to said storage tank from the top thereof to adjacent the bottom thereof;

a tube connecting the lower end of said drop-out tank to the upper end of said vertically positioned pipe;

the arrangement of said drop-out tank, said storage tank, said tube and said vertically positioned pipe being such that when the level of liquid in the underground storage tank has dropped sufficiently, a vacuum higher than the lift in said tube is created and flow of liquid will commence from the drop-out tank through said tube and continue until said drop-out tank is empty without further lowering of the level of liquid in said underground storage tank.

2. A vapor recovery system as recited in claim 1 including a supply pipe connecting said storage tank to said service station pump for supplying gasoline to said service station pump.

3. A vapor recovery system comprising:

a storage tank for liquids;

a drop-out tank, smaller than said storage tank, for collecting condensed vapors;

a substantially vertical pipe having an open lower end and a closed upper end positioned in said storage tank; and a tube connecting the lower portion of said drop-out tank to the upper portion of said vertical pipe;

said drop-out tank being located between the upper and lower portions of said storage tank and sufficiently near said storage tank so that when the level of liquid in the storage tank has dropped sufficiently upon removal of liquid from said storage tank a vacuum force greater than the lift in said tube is created and liquids will commence to flow from said drop-out tank through said tube and continue to flow until the level of liquid in said drop-out tank has reached the point where the tube connects to the lower portion of said drop-out tank.

4. A system as described in claim 3 in which said storage tank and said drop-out tank are located underground and said condensate is condensed gasoline vapors flowing from a surface gasoline station pump.

5. A system as recited in claim 4 including vapor venting means connected to said storage tank and to said drop-out tank for venting vapor from said tanks to the atmosphere.

6. A system as recited in claim 5 including means for pumping gasoline from said storage tank to said gasoline pump and means for filling said storage tank from the surface.

* * * * *